US008231398B2

(12) United States Patent
Rosenberger

(10) Patent No.: US 8,231,398 B2
(45) Date of Patent: Jul. 31, 2012

(54) CO-AXIAL CONNECTOR

(75) Inventor: Bernd Rosenberger, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/664,699

(22) PCT Filed: Jun. 2, 2008

(86) PCT No.: PCT/EP2008/004376

§ 371 (c)(1),
(2), (4) Date: Dec. 15, 2009

(87) PCT Pub. No.: WO2009/000385

PCT Pub. Date: Dec. 31, 2008

(65) Prior Publication Data

US 2010/0178798 A1 Jul. 15, 2010

(30) Foreign Application Priority Data

Jun. 25, 2007 (DE) ..... 20 2007 008 847 U

(51) Int. Cl.
*H01R 13/64* (2006.01)

(52) U.S. Cl. ..... 439/247; 248/675

(58) Field of Classification Search ..... 439/247, 439/248, 675, 578
See application file for complete search history.

(56) References Cited

U.S. PATENT DOCUMENTS

| | | | | | |
|---|---|---|---|---|---|
| 3,315,184 | A | * | 4/1967 | Wood | 333/241 |
| 3,416,125 | A | | 12/1968 | Theve | |
| 4,227,765 | A | * | 10/1980 | Neumann et al. | 439/248 |
| 4,789,351 | A | * | 12/1988 | Fisher et al. | 439/248 |
| 4,815,986 | A | | 3/1989 | Dholoo | |
| 5,329,262 | A | * | 7/1994 | Fisher, Jr. | 333/33 |
| 5,516,303 | A | * | 5/1996 | Yohn et al. | 439/248 |
| 6,350,155 | B1 | * | 2/2002 | Mullinger-Bausch et al. | 439/675 |
| 2006/0172561 | A1 | | 8/2006 | Clark | |

FOREIGN PATENT DOCUMENTS

| | | | |
|---|---|---|---|
| CH | 460110 | A | 7/1968 |
| DE | 15 91 440 | B1 | 4/1970 |
| DE | 10 2004 044975 | A1 | 3/2006 |
| EP | 0 741 436 | A | 11/1996 |

* cited by examiner

*Primary Examiner* — Hien Vu
(74) *Attorney, Agent, or Firm* — DeLio & Peterson, LLC; Robert Curcio

(57) ABSTRACT

A coaxial connector with an outer conductor having a first plug-side end and a second plug-side end, and an inner conductor having a first plug-side end and a second plug-side end. The inner conductor has a first inner conductor part forming the first plug-side end of the inner conductor and a second inner conductor part forming the second plug-side end of the inner conductor. The two inner conductor parts are arranged and configured such that they are mobile relative to each other in the axial direction, the inner conductor being configured as an inner conductor bellows between the two inner conductor parts. The inner conductor bellows is configured such that upon a change in length, a changing capacitance of the inner conductor bellows is compensated by a correspondingly changing opposite inductance of the inner conductor bellows such that the characteristic impedance of the coaxial connector remains substantially constant.

4 Claims, 3 Drawing Sheets

CO-AXIAL CONNECTOR

CROSS REFERENCE TO RELATED APPLICATION

This application is a National Phase filing under 35 U.S.C. §371 of PCT/EP/2008/004376 which was filed Jun. 2, 2008, and claims priority to German Application No. DE 20 2007 008 847.7 filed Jun. 25, 2007.

BACKGROUND OF THE INVENTION

1. Field of the Invention

The present invention relates to a co-axial connector having an outer conductor which has a first end for insertion, and a second end for insertion in an axially opposite position from the first end for insertion of the outer conductor, and having a center conductor which has a first end for insertion, and a second end for insertion in an axially opposite position from the first end for insertion of the center conductor, as defined in the preamble to claim 1.

2. Description of Related Art

Known from DE 10 2004 044 975 A 1 is a co-axial connecting part, having an outer-conductor sleeve and a center conductor, for connecting a co-axial socket to a circuit carrier. Arranged in the center conductor is a resiliently yielding bellows made of a conductive material to keep axial and radial forces which arise on entry to the socket away from the circuit carrier. The resilient bellows is for example produced by applying a thin layer of nickel to an aluminum blank by electroplating. Despite the resilient bellows, the connecting part can be produced to give low reflection. The outline shape of the bellows is so selected that the preset standard resistance of, for example, 50Ω exists in the co-axial outer-conductor sleeve even at the point where the bellows is situated. This can be calculated and applied with the help of a 3D simulator for radio-frequency electromagnetic problems.

Known from DE 199 26 483 A1 is a co-axial interface in which a displaceable attenuating sleeve in the form of a bellows structure is arranged on an outer conductor. This attenuating sleeve is so designed that, when the connecting means is withdrawn, the outer conductor, together with the bellows structure, produces wave-guide attenuation with a lower limiting frequency of attenuation of, for example 20 GHz, thus enabling the mechanically open RF connection to be considered screened and terminated from the electrical point of view. There is not however any change in the electrical and mechanical properties when the co-axial interface is connected by insertion. On the contrary, an outer conductor sleeve is provided which makes mechanical and electric contact in the inserted state and therefore puts the bellows structure out of action electrically when in the inserted state.

SUMMARY OF THE INVENTION

Bearing in mind the problems and deficiencies of the prior art, it is therefore an object of the present invention to provide an improved co-axial connector of the above kind in respect of its frequency-related behavior and its safety and reliability of operation.

This object is achieved in accordance with the invention by a co-axial connector of the above kind which has the features given in the characterizing clause of claim 1.

Still other objects and advantages of the invention will in part be obvious and will in part be apparent from the specification.

The above and other objects, which will be apparent to those skilled in the art, are achieved in the present invention which is directed to a co-axial connector having an outer conductor with first and second ends for insertion axially opposite each other, and having a center conductor with first and second ends for insertion axially opposite each other, the center conductor comprising two separate parts, with a first center-conductor part forming the first end for insertion of the center conductor and a second center-conductor part forming the second end for insertion of the center conductor. The two parts of the center conductor being so arranged and designed that they can be moved relative to one another in the axial direction. The center conductor taking the form, between the two center-conductor parts of a resilient center-conductor bellows, the resilient center-conductor bellows being so designed that, if there is a change in the length of the resilient center-conductor bellows, a varying capacitance of the resilient center-conductor bellows is compensated for by an inductance of the resilient center-conductor bellows which varies correspondingly in the opposite direction, in such a way that, if there is a change in the length of the resilient center-conductor bellows, the characteristic impedance of the co-axial connector remains substantially constant. The outer conductor may comprise two separate parts, with a first outer-conductor part forming the first end for insertion of the outer conductor and a second outer-conductor part forming the second end for insertion of the outer conductor. The two parts of the outer conductor being so arranged and designed that they can be moved relative to one another in the axial direction, there being provided on the outer conductor a first elastic resilient member which forces the two parts of the outer conductor away from one another in the axial direction. The first center-conductor part being movable in the axial direction relative to the first outer-conductor part, characterized in that the second center-conductor part is movable in the axial direction relative to the second outer-conductor part. There being provided on the center conductor a second elastic resilient member which forces the two center-conductor parts away from one another in the axial direction, at least one third stop being provided which limits the movement of the two center-conductor parts away from one another in the axial direction, a third stop being formed on each of the outer-conductor parts.

The co-axial includes having the outer conductor take the form, between the two outer-conductor parts of a resilient outer-conductor bellows, the resilient outer-conductor bellows being so designed that, if there is a change in the length of the resilient outer-conductor bellows, a varying capacitance of the resilient outer-conductor bellows is compensated for by an inductance of the resilient outer-conductor bellows which varies correspondingly in the opposite direction, in such a way that, if there is a change in the length of the resilient outer-conductor bellows, the characteristic impedance of the co-axial connector remains substantially constant.

The second elastic resilient member may comprise a coil spring. The third stops on the outer-conductor parts may be so arranged and designed that respective insulating discs which hold the center-conductor parts within the outer-conductor parts abut against these third stops.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
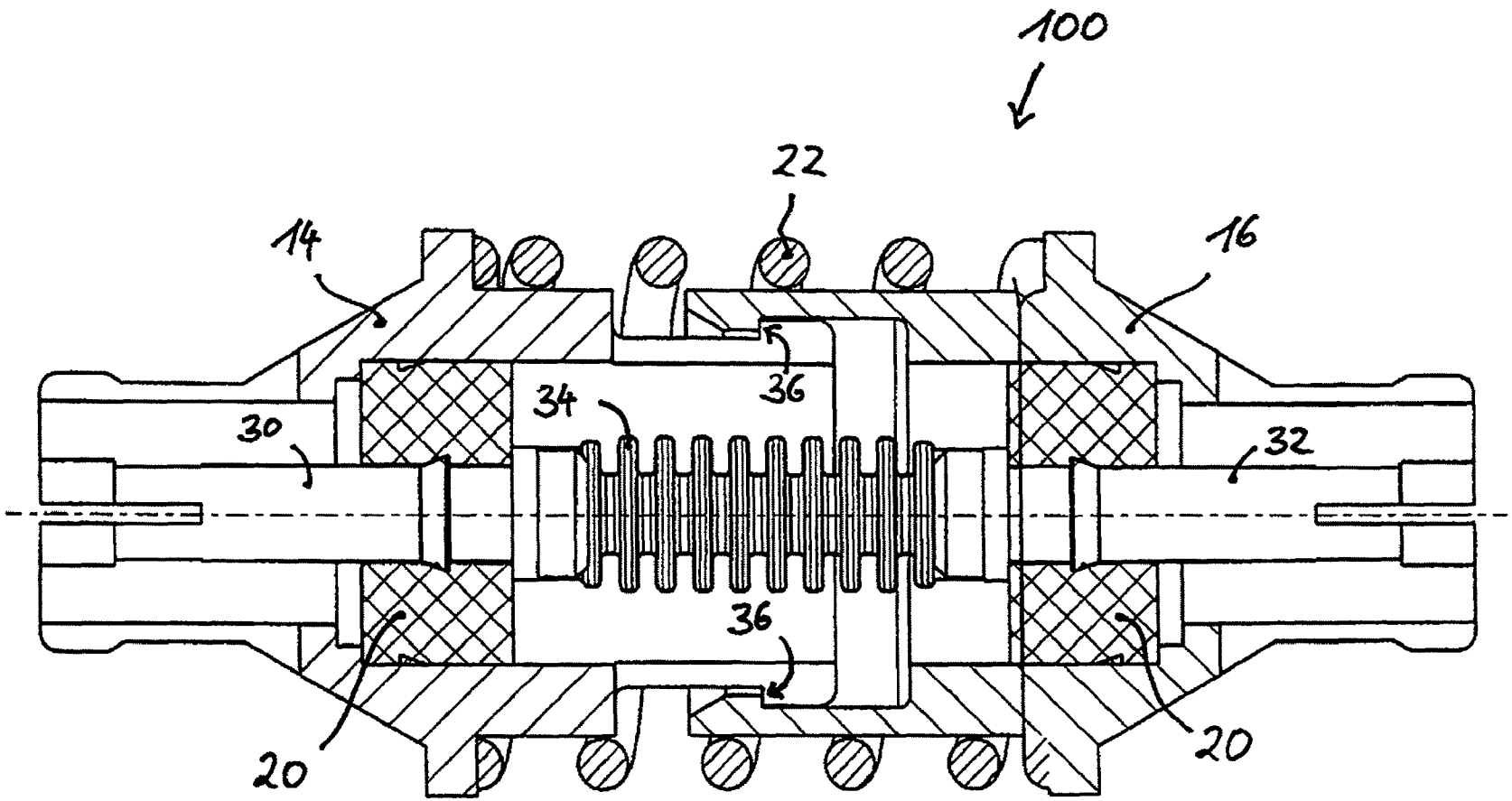
FIG. 1 is a view in section of a first preferred embodiment of co-axial connector according to the invention.

In describing the preferred embodiment of the present invention, reference will be made herein to FIGS. 1-3 of the drawings in which like numerals refer to like features of the invention.

In a co-axial connector of the above kind, provision is made in accordance with the invention for the center conductor to comprise two separate parts, with a first center-conductor part forming the first end for insertion of the center conductor and a second center-conductor part forming the second end for insertion of the center conductor, the two parts of the center conductor being so arranged and designed that they can be moved relative to one another in the axial direction, the center conductor taking the form, between the two center-conductor parts, of a resilient center-conductor bellows, the resilient center-conductor bellows being so designed that, if there is a change in the length of the resilient center-conductor bellows, a varying capacitance of the resilient center-conductor bellows is compensated for by an inductance of the resilient center-conductor bellows which varies correspondingly in the opposite direction, in such a way that, if there is a change in the length of the resilient center-conductor bellows, the characteristic impedance of the co-axial connector remains substantially constant.

This has the advantage that a co-axial connector for RF applications at frequencies above 20 GHz is available which has a means of compensating for length in the outer conductor, the electrical and mechanical properties of the co-axial connector not being adversely affected even if there is a change in the length of the outer conductor but being, on the contrary, improved over a wide frequency range.

So that there is also a means of compensating for length or tolerances available in the case of the outer conductor, thus producing other, additional improvements in the electrical properties of the co-axial connector, the outer conductor comprises two separate parts, with a first outer-conductor part forming the first end for insertion of the outer conductor and a second outer-conductor part forming the second end for insertion of the outer conductor, the two parts of the outer conductor being so arranged and designed that they can be moved relative to one another in the axial direction, the outer conductor taking the form, between the two outer-conductor parts, of a resilient outer-conductor bellows, there being provided on the outer conductor a first elastic resilient member which forces the two parts of the outer conductor away from one another in the axial direction, the resilient outer-conductor bellows being so designed that, if there is a change in the length of the resilient outer-conductor bellows, a varying capacitance of the resilient outer-conductor bellows is compensated for by an inductance of the resilient outer-conductor bellows which varies correspondingly in the opposite direction, in such a way that, if there is a change in the length of the resilient outer-conductor bellows, the characteristic impedance of the co-axial connector remains substantially constant.

In an illustrative embodiment the first center-conductor part is rigidly connected to the first outer-conductor part and the second center-conductor part is rigidly connected to the second outer-conductor part.

The first elastic resilient member is for example a coil spring.

A first stop is usefully provided which limits the movement of the two outer-conductor parts away from one another in the axial direction.

In a preferred embodiment, an outer-conductor sleeve is provided which fits round the two outer-conductor parts and which has second stops which limit an axial movement of the two outer-conductor parts away from one another.

A contacting force which is independent of the outer-conductor parts is obtained at the opposite ends for insertion of the center conductor by virtue of the fact that the first center-conductor part is movable in the axial direction relative to the first outer-conductor part and the second center-conductor part is movable in the axial direction relative to the second outer-conductor part, there being provided on the center conductor a second elastic resilient member which forces the two parts of the center conductor away from one another in the axial direction.

In a preferred embodiment the second elastic resilient member is a coil spring.

At least one third stop is usefully provided which limits the movement of the two center-conductor parts away from one another in the axial direction.

A third stop is for example formed on each of the outer-conductor parts.

In a preferred embodiment, the third stops on the outer-conductor parts are so arranged and designed that respective insulating discs which hold the center-conductor parts within the outer-conductor parts abut against these third stops.

Even when there is no resilient bellows on the outer conductor and even when the outer conductor is not divided into two, provision is made in an illustrative embodiment for the two parts of the center conductor to be so arranged and designed that they can each be moved in the axial direction relative to the outer conductor. In this case, there is provided on the center conductor a second elastic resilient member which forces the two parts of the center conductor away from one another in the axial direction. The first elastic resilient member is for example a coil spring. At least one third stop is usefully provided which limits the movement of the two center-conductor parts away from one another in the axial direction. These third stops are so arranged and designed, on the outer conductor for example, that respective insulating discs which hold the center conductor within the outer conductor abut against these third stops.

Figure 2:
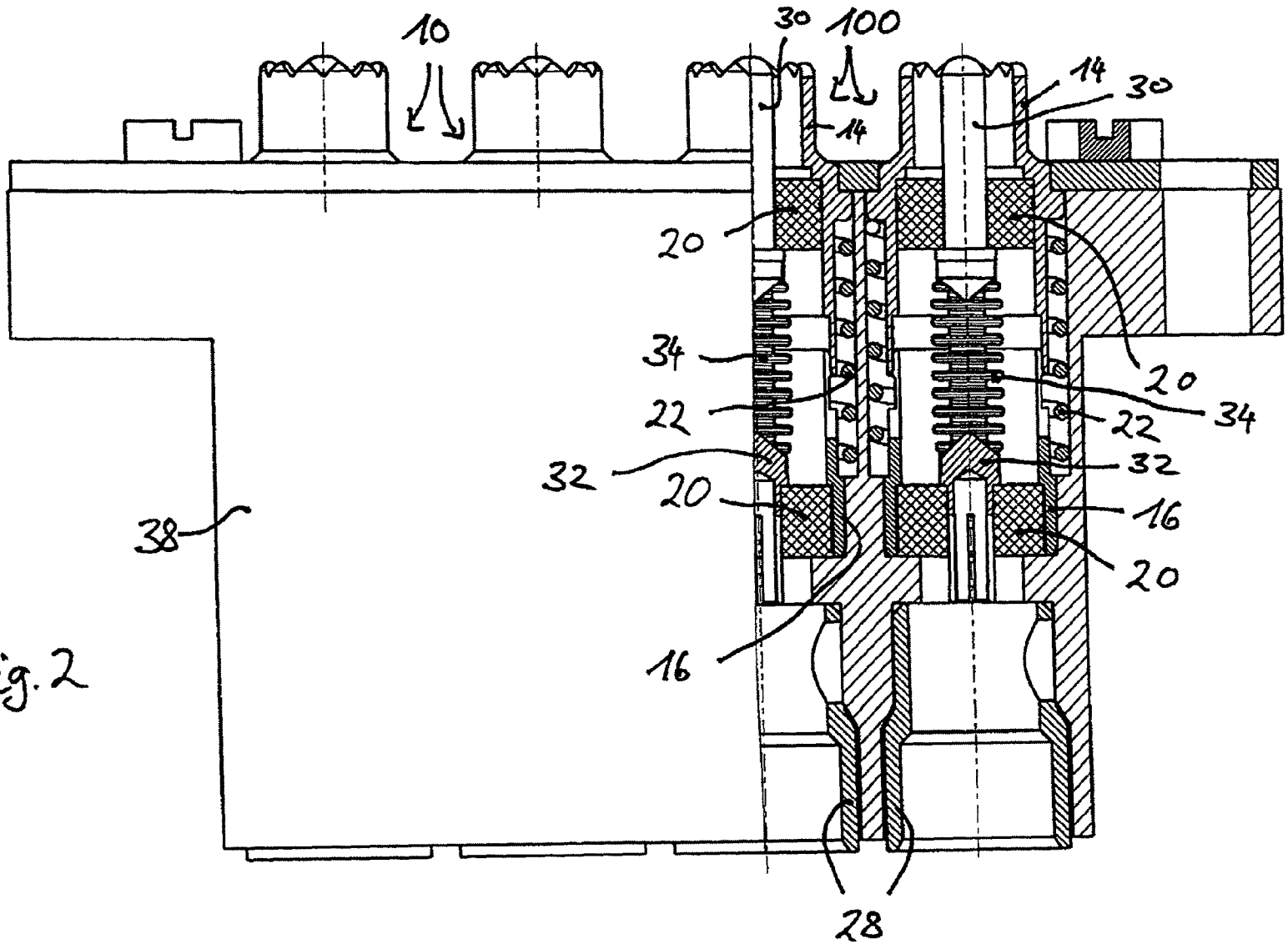
FIG. 2 is a view, partly in section, of an arrangement of a plurality of co-axial connectors conforming to the first preferred embodiment.

The first preferred embodiment of co-axial connector 100 according to the invention which is shown in FIGS. 1 and 2 comprises a center conductor and an outer conductor. The outer conductor is made up of a first outer-conductor part 14 which forms a first end for insertion of the outer conductor and a second outer-conductor part 16 which forms a second end for insertion of the outer conductor. The center conductor 12 is made up, in two parts, of a first center-conductor part 30 and a second center-conductor part 32, the center conductor taking the form, between the two center-conductor parts 30, 32, of a resilient center-conductor bellows 34. The two center-conductor parts 30, 32 are each held by an insulating disc 20 to be rigid or movable relative to the two outer-conductor parts 14, 16, i.e. the first center-conductor part 30 is rigidly or movably connected to the first outer-conductor part 14 by means of the insulating disc 20 and the second center-conductor part 32 is rigidly or movably connected to the second outer-conductor part 16 by means of the insulating disc 20. Because of this there is available on the center conductor a means of compensating for length and tolerances when the co-axial connector 100 is inserted. In the event of the outer-conductor parts 14, 16 and center-conductor parts 30, 32 being movable relative to one another, a second coil spring (not shown) is advantageously arranged in addition on the central conductor, in such a way that this coil spring presses the two center-conductor parts 30, 32 away from one another. This gives a means of compensating for length and tolerances which is independent of the outer conductor.

In the embodiment shown in FIGS. 1 and 2, the first center-conductor part 30 is rigidly connected to the first outer-conductor part 14 by means of the insulating disc 20 and the second center-conductor part 32 is rigidly connected to the second outer-conductor part 16 by means of the insulating disc 20. The two outer-conductor parts 14, 16 engage in one another and form a first stop 36 which limits an axial movement of the outer-conductor parts 14, 16 away from one another. Because the center-conductor parts 30, 32 are rigidly connected to the respective outer-conductor parts 14, 16, this first stop 36 at the same time sets a limit for the axial movement of the two center-conductor parts 30, 32 away from one another. There is also a coil spring 22 provided with is so arranged and designed that the said coil spring 22 presses the two outer-conductor parts 14, 16 apart from one another in the axial direction and against the first stop 36.

The resilient center-conductor bellows 34 is so designed that it provides a means of compensating for length and tolerances by a corresponding change in length, a varying capacitance of the resilient center-conductor bellows 34 if there is a change in the length of the resilient center-conductor bellows 34 being compensated for by an inductance of the resilient center-conductor bellows 34 which varies correspondingly in the opposite direction, in such a way that if there is a change in the length of the resilient center-conductor bellows 34 the characteristic impedance of the co-axial connector 100 remains substantially constant.

In the arrangement of a plurality of co-axial connectors 100 conforming to the first embodiment which is shown in FIG. 2, the co-axial connectors 100 are arranged next to one another in a housing 38 and are connected at one end to a complementary co-axial connector 28. Those respective ends for insertion of the co-axial connectors 100 which are free are used for insertion in complementary co-axial connectors which are similarly arranged next to one another (not shown), differences due to tolerances being compensated for by the resilient center-conductor bellows 34 if, as is possible, the complementary co-axial connectors 28 are not arranged exactly next to one another.

Figure 3:
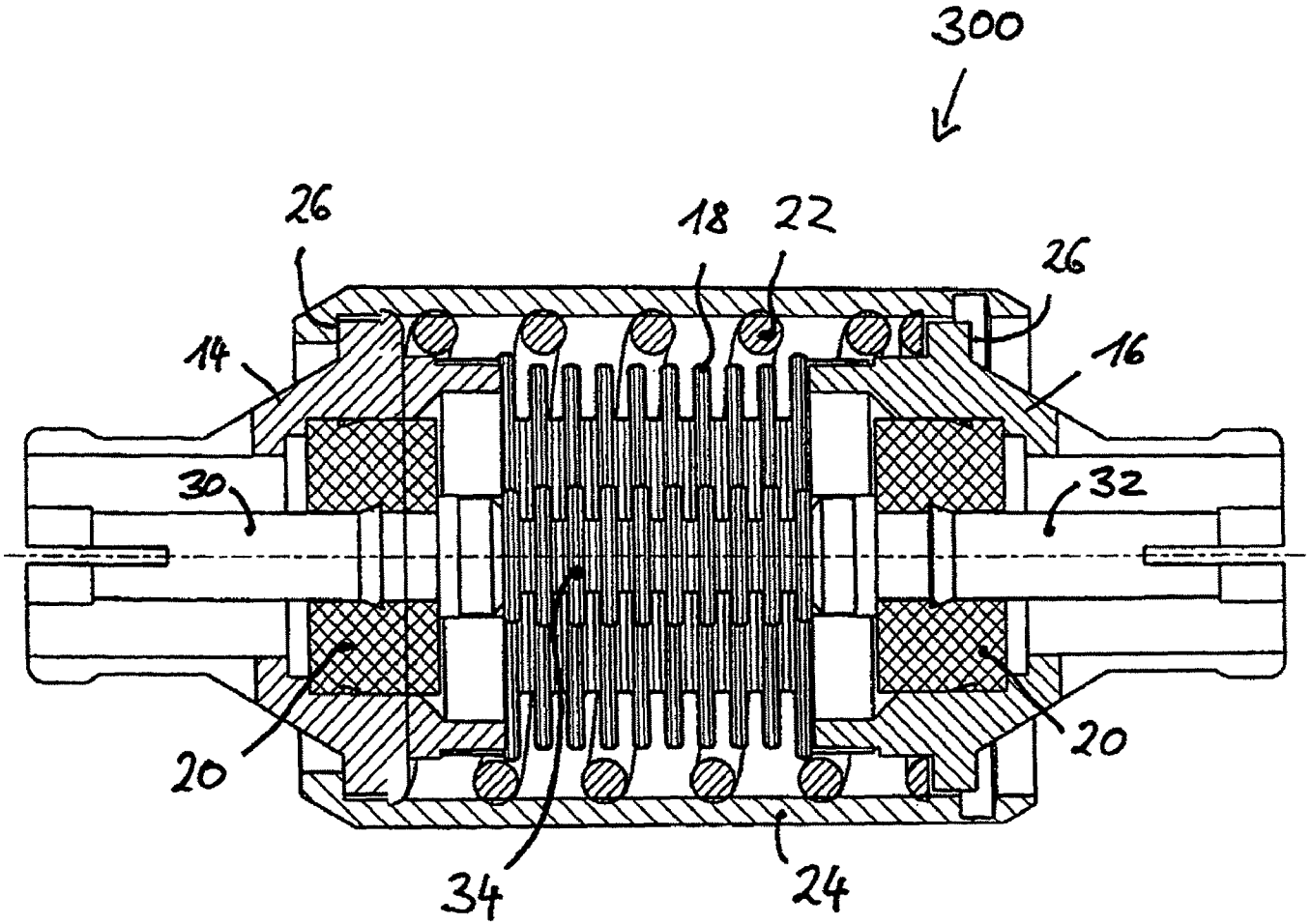
FIG. 3 is a view in section of a second preferred embodiment of co-axial connector according to the invention.

FIG. 3 shows a second preferred embodiment of co-axial connector 300 according to the invention, parts which perform the same function being identified by the same reference numerals as in FIGS. 1 and 2, which means that for an explanation of these parts reference should be made to the above description of FIGS. 1 and 2. In contrast to the first embodiment shown in FIGS. 1 and 2, the outer conductor takes the form, between the two outer-conductor parts 14, 16, of a resilient outer-conductor bellows 18. The two outer-conductor parts 14, 16 are able to move relative to one another in the axial direction in this way. This gives a means of compensating for tolerances and length which is independent of the outer conductor.

Instead of the first stop 36 as in the first embodiment 100, what is provided in this second embodiment 300 shown in FIG. 3 is an outer-conductor sleeve 24 which surrounds the two outer-conductor parts 14, 16 and guides the said two outer-conductor parts 14, 16 in the axial direction, stops 26 being formed which limit an axial movement of the two outer-conductor parts 14, 16 away from one another. The coil spring 22 is fitted in the outer-conductor sleeve 24 under a pre-loading, thus causing the coil spring 22 to press the two outer-conductor parts 14, 16 against the stops 26 when the co-axial connector is in the un-inserted state, as shown in FIG. 3.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A co-axial connector including:

an outer-conductor having a first end for insertion and a second end for insertion in an axially opposite position from the first end for insertion of the outer-conductor;

a center-conductor having a first end for insertion and a second end for insertion in an axially opposite position from the first end for insertion of the center-conductor, the center-conductor comprising two separate parts, a first center-conductor part forming the first end for insertion of the center-conductor and a second center-conductor part forming the second end for insertion of the center-conductor, the two parts of the center-conductor moveable relative to one another in the axial direction, the center-conductor forming a resilient inner bellows between the two center-conductor parts, the resilient bellows including a capacitance that varies with a change in length which is compensated for by an inductance which varies correspondingly in the opposite direction, such that, if there is a change in the length of the resilient bellows, the characteristic impedance of the co-axial connector remains substantially constant;

the outer-conductor comprising two separate parts, a first outer-conductor part forming the first end for insertion of the outer-conductor and a second outer-conductor part forming the second end for insertion of the outer-conductor, the two parts of the outer-conductor movable relative to one another in the axial direction, the outer-conductor including a first outer elastic resilient spring member which abutted against the two parts for forcing the two parts of the outer-conductor away from one another in the axial direction;

the first center-conductor part movable in the axial direction relative to the first outer-conductor part, the second center-conductor part movable in the axial direction relative to the second outer-conductor part, the center-conductor including a second inner elastic resilient member forcing the two center-conductor parts away from one another in the axial direction; and at least one stop for limiting the movement of the two center-conductor parts away from one another in the axial direction, the at least one stop being formed on each of the outer-conductor parts.

2. The co-axial connector of claim 1 wherein the outer conductor includes, between the two outer-conductor parts, a resilient outer-conductor bellows, the resilient outer-conductor bellows including a capacitance that varies with a change in length which is compensated for by an inductance which varies correspondingly in the opposite direction, such that, if there is a change in the length of the resilient outer-conductor bellows, the characteristic impedance of the co-axial connector remains substantially constant.

3. The co-axial connector of claim 1 including having the at least one stop on the outer-conductor parts positioned such that insulating discs which hold the center-conductor parts within the outer-conductor parts, and an outer conductor sleeve abut against the at least one stop.

4. The co-axial connector of claim 2 including having the at least one stop on the outer-conductor parts positioned such that insulating discs which hold the center-conductor parts within the outer-conductor parts, and an outer conductor sleeve abut against the at least one stop.

* * * * *